United States Patent [19]

Lelental

[11] 4,343,880

[45] Aug. 10, 1982

[54] DYE-FORMING ELECTRICALLY ACTIVATABLE RECORDING MATERIAL AND PROCESS

[75] Inventor: Mark Lelental, Rochester, N.Y.

[73] Assignee: Eastman Kodak Company, Rochester, N.Y.

[21] Appl. No.: 161,626

[22] Filed: Jun. 20, 1980

Related U.S. Application Data

[63] Continuation-in-part of Ser. No. 55,945, Jul. 9, 1979, abandoned.

[51] Int. Cl.[3] ..... G03G 15/24; G03G 13/22

[52] U.S. Cl. ..... 430/42; 430/45; 430/351; 430/353; 430/502; 430/618; 430/619

[58] Field of Search ..... 430/55, 620, 353, 351, 430/42, 502, 524, 618, 619, 45, 48; 250/320

[56] References Cited

U.S. PATENT DOCUMENTS

| | | | |
|---|---|---|---|
| 3,978,335 | 8/1976 | Gibbons | 250/320 |
| 4,113,484 | 9/1978 | Lelental et al. | 430/413 |
| 4,126,461 | 11/1978 | Pupo et al. | 430/402 |
| 4,137,079 | 1/1979 | Houle | 430/353 |
| 4,152,155 | 5/1979 | Lelental et al. | 430/353 |
| 4,155,760 | 5/1979 | Lelental et al. | 430/353 |
| 4,234,670 | 11/1980 | Kaukeinen et al. | 430/618 |

*Primary Examiner*—John E. Kittle
*Assistant Examiner*—John L. Goodrow
*Attorney, Agent, or Firm*—Richard E. Knapp

[57] ABSTRACT

A dye-forming electrically activatable recording element comprises an electrically conductive support having thereon (a) an electrically activatable recording layer comprising in an electrically conductive polymeric binder, an organic silver salt and a reducing agent, (b) a photoconductive layer separated from (a) by an air gap of up to 20 microns, and (c) an electrically conductive layer on (b), wherein the recording layer (a) comprises in reactive association, (A) a dye-forming coupler, and (B) an oxidation-reduction combination comprising (i) an organic silver salt oxidizing agent, with (ii) a reducing agent which in its oxidized form forms a dye with the dye-forming coupler. The recording element can be room light handleable and can provide a dye image and silver image by dry development processing.

23 Claims, 5 Drawing Figures

LATENT IMAGE FORMATION

HEAT DEVELOPMENT

LATENT IMAGE FORMATION

DYE-FORMING ELECTRICALLY ACTIVATABLE RECORDING MATERIAL AND PROCESS

This is a continuation-in-part application of U.S. Ser. No. 055,945 of M. Lelental, filed July 9, 1979, now abandoned entitled "Dye-Forming Electrically Activated Recording Material and Process".

BACKGROUND OF THE INVENTION

1. Field of the Invention

This invention relates to dye-forming charge-sensitive recording materials. One aspect of the invention relates to the use of (A) a dye-forming coupler, and (B) an image-forming combination in a charge-sensitive recording material which is capable of producing a dye image and silver image by dry development processes.

2. Description of the State of the Art

A variety of recording materials and processes have been proposed to provide image recording. The better known and commercially more successful of these recording materials and processes can be classified as photographic, thermographic or electrographic or as a combination of two or more of these processes. For example, one known recording material is a photothermographic material which is a heat developable photosensitive material. Each of the known image recording materials and processes have certain advantages for particular uses. However, the materials and processes also suffer from disadvantages which limit the usefulness in particular applications. For example, conventional photographic materials have the disadvantage that they are not room light handleable prior to imagewise exposure and processing. Thermographic materials require imagewise heating to provide a visible image and are not capable of the degree of light sensitivity provided by conventional photographic materials. Electrographic materials including, for example, xerographic materials require mechanical dust pattern transfer procedures to provide a desired image.

It has been desirable to provide an image recording material and process which enable the formation of a dye image and a silver image under daylight conditions, yet avoid the need for conventional processing baths and solutions.

Heat developable photographic materials which after imagewise exposure can be heated to produce a developed image in the absence of processing solutions or baths are known. These photosensitive materials have the disadvantage that they are not room light handleable prior to imagewise exposure for recording purposes.

Another means proposed for imaging involves a recording material which produces an image by passing an electric current through the recording material. Such recording materials involve electrographic image recording techniques. One such recording material comprises a conventional light-sensitive photographic material that is positioned contiguous to a photoconductive layer for image recording purposes. Upon applying a uniform electric field across the photoconductive and photographic layers and simultaneously imagewise exposing the photoconductive layer to a light pattern, an imagewise current flow is produced in the photographic layer. This imagewise current flow is produced in the photographic layer. This imagewise current flow, in turn, produces a developable latent image in the photographic layer. The recording material, however, has the disadvantages associated with light-sensitive photographic materials which require processing with conventional solutions and baths. Moreover, the material requires a substantial current flow in the recording layer and therefore provides a relatively lengthy exposure time with low current flow or a high current flow with a short exposure time.

Dry electrographic recording materials and processes which involve production of a visible image in a charge-sensitive recording element have been described in, for example, French Pat. No. 2,280,517, published Feb. 27, 1976, and U.S. Pat. No. 4,113,484. Such dry electrographic recording materials can be processed by dry development techniques. However, no suggestion is given of producing a dye image and silver image in such a recording material and process.

Accordingly, a continuing need has existed to provide an electrically activatable recording element that (a) avoids the need for conventional processing solutions and baths, (b) enables room light handling of the recording material prior to imagewise exposure and processing, and (c) enables the formation of a dye image and silver image, preferably a dye image that enhances the silver image.

SUMMARY OF THE INVENTION

It has been found according to the invention that the described advantages are provided in an electrically activatable recording element comprising an electrically conductive support having thereon, in sequence, (a) an electrically activatable recording layer comprising an organic silver salt and a reducing agent, and (b) a photoconductive layer separated from (a) by an air gap of up to 20 microns, and (c) an electrically conductive layer on (b), wherein the recording layer comprises, in reactive association, (A) a dye-forming coupler, and (B) an oxidation-reduction combination comprising (i) an organic silver salt oxidizing agent, with (ii) a reducing agent which, in its oxidized form, forms a dye with the dye-forming coupler. Such an electrically activatable recording element enables formation of a dye image and silver image by heat processing after imagewise exposure. The electrically activatable recording element according to the invention preferably also comprises an electrically active conductive layer (EAC layer) on the electrically conductive support and contiguous to the electrically activatable recording layer (a). This EAC layer helps increase the sensitivity of the electrically activatable recording layer (a) during imaging.

It has also been found according to the invention that a dye image and silver image, especially a dye enhanced silver image, can be produced by a dry, electrically activated recording process comprising the steps of (I) applying an electric potential imagewise to an electrically activatable recording layer of a charge-sensitive recording element of a magnitude and for a sufficient time to produce in the image areas a charge density within the range of about $10^{-3}$ coulomb/cm$^2$ to about $10^{-9}$ coulomb/cm$^2$, said charge density forming a developable latent image in the charge-sensitive recording layer; and, then (II) heating the element substantially uniformly at a temperature and for a time sufficient to produce a dye image and silver image, preferably a dye enhanced silver image, in the recording layer. In this process embodiment, the electrically activatable recording layer comprises the described components; however, other means that an photoconductor can be useful to produce the desired charge density in the recording layer, such as a contact or non-contact electrode.

A further process which has been found according to the invention which produces a dye image and silver image, preferably a dye enhanced silver image, comprises (I) imagewise altering the conductivity of the photoconductive layer of the described element in accord with an image to be recorded; (II) applying across the photoconductive layer and recording layer an electrical potential of a magnitude and for a sufficient time to produce a developable latent image in the recording layer corresponding to the image to be recorded; and then (III) heating the recording layer substantially uniformly at a temperature and for a time sufficient to produce a dye image and a silver image, preferably a dye enhanced silver image, in the recording layer. The step (I) of imagewise altering the conductivity of the photoconductive layer is preferably carried out while simultaneously (II) applying the described electrical potential across the photoconductive layer and recording layer.

A further process which has been found according to the invention is a dry, electrically activated recording process for producing a dye image and silver image, preferably a dye enhanced silver image, in an electrically activatable recording element comprising the steps: (I) imagewise altering the conductivity of a photoconductive layer (Z) in accord with an image to be recorded; (II) positioning the imagewise altered photoconductive layer (Z) from (I) in face-to-face relationship with an electrically activatable recording layer (Y) of the recording element, which element comprises (A) a dye-forming coupler, and (B) an image-forming combination comprising (i) an organic silver salt oxidizing agent, with (ii) a reducing agent which, in its oxidized form, forms a dye with the dye-forming coupler; (III) applying across the photoconductive layer and recording layer an electrical potential of a magnitude and for a time sufficient to produce in the areas of the recording layer corresponding to the imagewise altered portions of the photoconductive layer a charge density within the range of about $10^{-3}$ coulomb/cm$^2$ to about $10^{-9}$ coulomb/cm$^2$, the charge density forming in the areas a developable latent image; and then (IV) uniformly heating the recording element at a temperature and for a time sufficient to produce a dye image and silver image, especially a dye enhanced silver image, in the recording element.

Another process according to the invention is a dye electrically activated recording process for producing a dye image and silver image, preferably a dye enhanced silver image, in a charge-sensitive recording element, preferably having ohmic resistivity within the range of about $10^4$ to about $1\times10^{12}$ ohm-cm, containing at least one electrically activatable recording material comprising in an electrically conductive binder, (A) a dye-forming coupler, and (B) an image-forming combination comprising (i) an organic silver salt oxidizing agent, with (ii) a reducing agent which, in its oxidized form, forms a dye with the dye-forming coupler; comprising the steps: (I) positioning the recording material on an electrically conductive backing member; (II) modulating a corona ion current flow to the recording element by an electrostatic field established imagewise between an image grid comprising an electroconductive core sequentially connectable to sources of different potential relative to the backing member and covered with a coating of a photoconductive insulating material and a control grid that is electrically conductive and sequentially connectable to sources of different potential relative to the backing member, said current flow being of a magnitude sufficient to produce a charge density within the range of about $10^{-3}$ to about $10^{-9}$ coulomb/cm$^2$ imagewise in said recording element, which charge density forms a developable latent image in the electrically activatable recording material; and, (III) substantially uniformly heating the recording element at a temperature and for a time sufficient to produce a dye enhanced silver image in the recording element.

The heating step in each of the described process embodiments can be carried out at a temperature within the range of about 80° C. to about 200° C., typically at a temperature within the range of about 100° C. to about 180° C., until the desired silver image and dye image are formed.

DETAILED DESCRIPTION OF THE INVENTION

Figure 1:
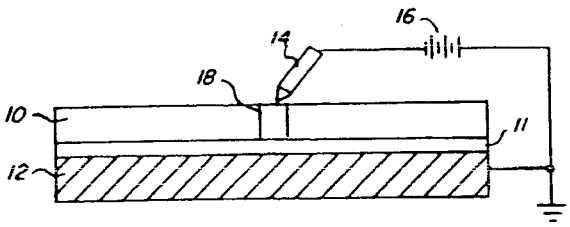
FIGS. 1 and 2 illustrate schematically an image recording material and process according to one illustrative embodiment of the invention.

Many dye-forming couplers, organic silver salt oxidizing agents and reducing agents which, in their oxidized form, form a dye with the dye-forming coupler, may be used in the described electrically activated recording materials according to the invention. The exact mechanism by which the latent image is formed in the recording material is not fully understood. It is postulated that the injection of a charge carrier due to the electric field into the combination of components results in the formation of a developable latent image in the electrically activated recording layer. It is believed that the development of the latent image is accomplished by a reaction in which the latent image catalyzes the reaction of the described image-forming combination. In such a reaction, the organic silver salt oxidizing agent reacts with the described reducing agent. Then, the oxidized form of the reducing agent resulting from this reaction, in turn, reacts with the dye-forming coupler to produce a dye in the image areas. It is not entirely clear, however, what part, if any, the dye-forming coupler and the other described components play in latent image formation. When an EAC layer is present in an electrically activatable recording element, the EAC layer enables increased charge sensitivity in the element. The exact mechanism by which the EAC layer enables this increased sensitivity is not fully understood. Some form of interaction occurs between the electrically activated recording layer and the EAC layer.

While a variety of image recording combinations containing the described components can be useful, the optimum image recording combination and image recording element will depend upon such factors as the desired image, the particular image-forming combination, the source of exposing energy, processing condition ranges and the like.

The term "charge-sensitive recording material", as used herein, is intended to mean a material which, when subjected to an electrical current or subjected to an electrical potential field, undergoes a chemical and/or electrical change which provides a developable latent image.

The term "latent image", as used herein, is intended to mean an image that is not visible to the unaided eye or is faintly visible to the unaided eye and that is capable of amplification in a subsequent processing step, especially in a subsequent heat development step.

The term "resistive recording material", as used herein, is intended to mean a material that has an ohmic resistivity of at least about $10^4$ ohm-cm.

The term "electrically conductive", such as in "electrically conductive support" or "electrically active conductive layer", is intended herein to mean a support or layer that has a resistivity less than about $10^{12}$ ohm-cm.

Many photoconductors are useful in an element according to the invention. Selection of an optimum photoconductor depends upon such factors as the particular electrically activated recording layer, the charge sensitivity of the element, the desired image, the ohmic resistivity desired, exposure means, processing conditions and the like. It is advantageous to select a photoconductor which has the property of being the most useful with the operative voltages to be used for imaging. The photoconductor is either an organic photoconductor or an inorganic photoconductor. Combinations of photoconductors are useful. The resistivity of the photoconductor can change rapidly in the operating voltage ranges which can be useful according to the invention. In some cases, it is desirable that the photoconductive layer have what is known in the art as persistent conductivity. Examples of useful photoconductors include lead oxide, cadmium sulfide, cadmium selenide, cadmium telluride, selenium and lanthanum oxide. Useful organic photoconductors include, for instance, polyvinyl carbazole/-trinitrofluorenone photoconductors and aggregate type organic photoconductors described in, for example, U.S. Pat. No. B 3,615,414. These photoconductors are known in the image recording art and are described in, for example, U.S. Pat. No. 3,577,272; *Research Disclosure*, August 1973, Item No. 11210 of Reithel, published by Industrial Opportunities Limited, Homewell, Havant, Hampshire, P09 1EF, United Kingdom; "Electrography", by R. M. Schaffert (1975), and "Xerography and Related Processes", by Dessauer and Clark (1965), both published by Focal Press Limited, and U.S. Pat. No. 3,615,414.

An especially useful photoconductive layer comprises a dispersion of lead oxide in an insulating binder, such as a binder comprising a polycarbonate (for example, LEXAN, a trademark of General Electric Company, U.S.A., consisting of a Bisphenol A polycarbonate), polystyrene or poly(vinyl butyral).

A recording element according to the invention is especially useful wherein the photoconductive layer is X-ray sensitive and the conductivity of the photoconductor layer can be imagewise altered by imagewise exposing the photoconductive layer to X-ray radiation.

Many dye-forming couplers are useful in the element and process as described. The exact mechanism by which the dye image and silver image are produced is not fully understood. However, it is believed that the dye-forming coupler reacts with the described oxidized form of the reducing agent to form a desired dye. The dye-forming coupler herein is accordingly intended to mean a compound or combination of compounds which, with other of the described components, produces a desired dye image upon heating the recording layer after exposure. There are designated as dye-forming couplers because it is believed that the compounds couple with the oxidized developer to produce the desired dye. The dye-forming couplers described herein are also known in the photographic art as color-forming couplers. Combinations of dye-forming couplers are useful. Selection of a suitable dye-forming coupler will be influenced by such factors as the desired dye image, other components of the recording layer, processing conditions, particular reducing agent in the recording layer and the like. An example of a useful magenta dye-forming coupler is 1-(2,4,6-trichlorophenol)-3-[3-]α-(3-pentadecylphenoxy)butryamido[benzamido]-5-pyrazolone. A useful cyan dye-forming coupler is the described 2,4-dichloro-1-naphthol. A useful yellow dye-forming coupler is α-[3-{α-(2,4-di-tertiary-amylphenoxy)acetamido}benzoyl]-2-fluoroacetanilide. Useful cyan, magenta and yellow dye-forming couplers are selected from those described in, for example, "Neblette's Handbook of Photography and Reprography", edited by John M. Sturge, Seventh Edition, 1977, pages 120 and 121, and *Research Disclosure*, December 1978, Item No. 17643, paragraphs VII C–G.

An especially useful dye-forming coupler is a resorcinol dye-forming coupler. The resorcinol dye-forming coupler is preferably one that produces a neutral (black) or nearly neutral appearing dye with the oxidized form of the described reducing agent. Mono-substituted resorcinol dye-forming couplers containing a substituent in the two position are especially useful. The resorcinol dye-forming coupler and other components in the recording layer should be sufficiently stable to avoid any significant adverse interaction in the recording layer prior to imagewise exposure and processing. Many resorcinol dye-forming couplers are useful. A useful resorcinol dye-forming coupler is typically one represented by the formula:

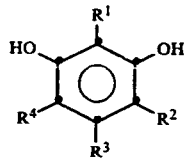

wherein:

$R^1$ is hydrogen,

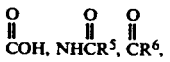

or $NHSO_2R^7$;

$R^2$ is hydrogen,

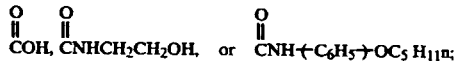

$R^3$ is hydrogen,

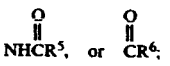

$R^4$ is hydrogen, $$\overset{O}{\overset{\|}{C}}OH,\ \overset{O}{\overset{\|}{C}}NHCH_2CH_2OH,\ \text{or}\ \overset{O}{\overset{\|}{C}}NH\text{-}(C_6H_5)\text{-}C_5H_{11}n;$$

$R^5$ is haloalkyl containing 1 to 3 carbon atoms, such $CCl_3$, $CF_3$, and $C_3H_4Br_3$, $CH_2OCH_3$, $CH_2SR^7$, $NHR^8$, $C_2H_4COOH$, $CH{=}CH_2$, $NHC_2H_4Cl$, alkyl containing 1 to 20 carbon atoms, such as 1 to 10 carbon atoms, including methyl, ethyl, propyl, and decyl, or phenyl;

$R^6$ is OH, $NH_2$, $NHCH_2CH_2OH$, and $NH\text{-}(C_6H_5)\text{-}OC_5H_{11}n$;

$R^7$ is alkyl containing 1 to 5 carbon atoms, such as methyl, ethyl, propyl or pentyl, or phenyl; and $R^8$ is hydrogen, haloalkyl containing 1 to 3 carbon atoms, such as $CCl_3$, $CF_3$ and $C_3H_4Br$, $CH_2OCH_3$, or $C_2H_4COOH$.

The letter n, such as in $$\overset{O}{\overset{\|}{C}}NH\text{-}(C_6H_5)\text{-}OC_5H_{11}n.$$

means normal.

Alkyl and phenyl, as described, are intended to include alkyl and phenyl that are unsubstituted alkyl and phenyl, as well as alkyl and phenyl that contain substituent groups that do not adversely affect the desired image. An example of a suitable substituent group is alkyl containing 1 to 3 carbon atoms, such as methyl or ethyl.

Examples of useful resorcinol dye-forming couplers are described in, for example, *Research Disclosure*, September 1978, Item No. 17326. Especially useful resorcinol dye-forming couplers include 2,'6'-dihydroxyacetanilide and 2',6'-dihydroxytrifluoroacetanilide. Another useful resorcinol dye-forming coupler is 2',6'-dihydroxy-2,5-dimethylbenzanilide (2',6'-dihydroxyacetanilide has also been known as 2,6-dihydroxyacetanilide, and 2',6'-dihydroxy-2,5-dimethylbenzanilide has also been known as 2,6-dihydroxy-2',5'-dimethylbenzanilide).

Resorcinol dye-forming couplers as described can be prepared by procedures known in the chemical art. For example, resorcinol couplers as described can be prepared from amino resorcinols or dihydroxybenzoic acids.

The dye-forming coupler is useful in a range of concentrations in the described recording layer. The recording layer generally contains a concentration of dye-forming coupler that is within the range of about 0.1 to about 1.0 mole of the dye-forming coupler per mole of total silver in the recording layer. An especially useful concentration of dye-forming coupler is within the range of about 0.25 to about 0.75 mole of dye-forming coupler per mole of total silver in the recording layer.

Selection of an optimum concentration of dye-forming coupler will depend upon such factors as the particular coupler, the desired image, processing conditions, other components in the recording layer and the like.

Many organic silver salt oxidizing agents are useful in the described image-forming combination in the recording layer. The organic silver salt oxidizing agent is typically resistant to darkening upon illumination, which helps reduce undesired deterioration of the developed image. One class of useful silver salt oxidizing agents is represented by the silver salts of long-chain fatty acids which are stable to light. The term "long-chain", as used herein, is intended to mean a chain of carbon atoms containing 10 to 30 carbon atoms. Compounds within this class which are useful include silver behenate, silver stearate, silver oleate, silver laurate, silver hydroxystearate, silver caprate, silver myristate and silver palmitate.

Another useful class of organic silver salt oxidizing agents include silver salts of certain heterocyclic thione compounds. Useful silver salts of heterocyclic thione compounds include, for example, those represented by the formula:

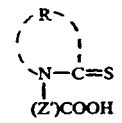

wherein:

Z' is alkylene containing 1 to 10 carbon atoms, such as methylene, ethylene and propylene; and R represents the atoms necessary to complete a heterocyclic nucleus selected from carbon, oxygen, sulfur and nitrogen atoms, such as a thiazoline or imidazoline nucleus.

Useful silver salts of the described thione compounds include, for example, the silver salts of the following compounds:

3-(2-carboxyethyl)-4-methyl-4-thiazoline-2-thione;
3-(2-carboxyethyl)benzothiazoline-2-thione;
3-(2-carboxyethyl)-5-phenyl-1,3,4-oxadiazoline-2-thione;
3-(2-carboxyethyl)-5-phenyl-1,3,4-thiadiazoline-2-thione;
3-carboxymethyl-4-methyl-4-thiazoline-2-thione;
3-(2-carboxyethyl)-1-phenyl-1,3,4-triazoline-2-thione;
1,3-bis(2-carboxyethyl)imidazoline-2-thione;
1,3-bis(2-carboxyethyl)benzimidazoline-2-thione;
3-(2-carboxyethyl)-1-methylimidazoline-2-thione;
3-(2-carboxyethyl)benzoxazoline-2-thione; and
3-(1-carboxyethyl)-4-methyl-4-thiazoline-2-thione.

Another useful class of organic silver salt oxidizing agents is represented by the complexes of silver with nitrogen acids, such as nitrogen acids selected from the group consisting of imidazole, pyrazole, urazole, 1,2,4-triazole and 1H-tetrazole nitrogen acids or combinations of these acids. These silver salts of nitrogen acids are described in, for example, *Research Disclosure*, October 1976, Item No. 15026. Examples of useful silver salts of nitrogen acids are the silver salts of the following compounds: 1H-tetrazole; 5-dodecyltetrazole; 5-n-butyl-1H-tetrazole; 1,2,4-triazole; urazole; pyrazole; imidazole and benzimidazole.

Another useful class of silver salt oxidizing agents is represented by the silver salts of 1,2,4-mercaptotriazole derivatives represented by the formula:

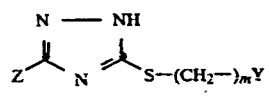

(I)

wherein:

Y is aryl containing 6 to 12 carbon atoms, such as phenyl, naphthyl and para-chlorophenyl;

m is 0 to 2; and

Z is hydrogen, hydroxyl or amine (—$NH_2$).

Especially useful organic silver salt oxidizing agents within this class are those silver salts of the described 1,2,4-mercaptotriazole derivatives, wherein Y is phenyl, naphthyl or para-chlorophenyl, and Z is amine (—$NH_2$) in the above formula (I'). An example of such a compound is the silver salt of 3-amino-5-benzylthio-1,2,4-triazole (referred to herein as ABT). Such organic silver salt oxidizing agents are described in, for instance, U.S. Pat. Nos. 4,123,474 and 4,128,557.

Combinations of silver salt oxidizing agents are useful. An example of a combination of silver salt oxidizing agents is the combination of the silver salts of ABT with the silver salt of 1-methyl-4-imidazoline-2-thione. Other combinations include the combinations of the silver salt of ABT with silver salts of nitrogen acids described in *Research Disclosure*, October 1976, Item No. 15026.

Selection of an optimum silver salt oxidizing agent or combination of silver salt oxidizing agents will depend upon the described factors, such as the desired image, the particular reducing agent, the particular dye-forming coupler, processing conditions, the particular binder and the like. An especially useful silver salt oxidizing agent is the silver salt of ABT.

The silver salt oxidizing agent and combination of silver salt oxidizing agents are useful in a range of concentrations in the described recording layer. Selection of an optimum concentration of silver salt oxidizing agent or combination of silver salt oxidizing agents depends upon the described factors, such as the desired image, the particular reducing agent, the particular dye-forming coupler and processing conditions. A typically useful concentration of silver salt oxidizing agent or combination of silver salt oxidizing agents is within the range of about 0.1 mole to about 2.0 moles of silver salt oxidizing agent per mole of reducing agent in the recording layer. For example, when the silver salt oxidizing agent is the silver salt of ABT, a typically useful concentration of the silver salt oxidizing agent is within the range of about 0.1 to about 2.0 moles of silver salt oxidizing agent per mole of reducing agent in the recording layer.

Preparation of the described organic silver salt oxidizing agent is typically not carried out in situ; that is, not in combination with other components of the recording layer as described. Rather, the preparation of the oxidizing agent is typically carried out ex situ; that is, separate from other components of the recording layer. In most instances, the preparation of the silver salt oxidizing agent will be separate from the other components based on the ease of control of preparation and storage capability.

The term "salt", as used herein, such as in organic silver salt, is intended to include any type of bonding or complexing mechanism which enables the resulting material to produce desired imaging properties in the described recording layer. In some instances, the exact bonding of the described silver salt with the organic compound is not fully understood. Accordingly, the term "salt" is intended to include what are known in the chemical art as "complexes". The term "salt" is intended to include, for example, neutral complexes and non-neutral complexes. The term is also intended to include compounds which contain any form of bonding which enables the desired image-forming combination to provide the desired image.

Many reducing agents which, in their oxidized form, form a dye with the described dye-forming coupler are useful in the recording element according to the invention. The reducing agent is typically an organic silver halide color developing agent. Combinations of reducing agents are useful. It is important that the reducing agent produces an oxidized from upon reaction with the organic silver salt oxidizing agent which can react at processing temperature with the described dye-forming coupler to produce a desired dye. Especially useful reducing agents are primary aromatic amines including, for example, paraphenylenediamines. Examples of useful reducing agents which are primary aromatic amines include 4-amino-N,N-dimethylaniline; 4-amino-N,N-diethylaniline; 4-amino-3-methyl-N,N-diethylaniline (also known as N,N-diethyl-3-methyl-paraphenylenediamine); 4-amino-N-ethyl-N-β-hydroxyethylaniline; 4-amino-3-methyl-N-ethyl-N-β-hydroxyethylaniline; 4-amino-3-methoxy-N-ethyl-N-β-hydroxyethylaniline; 4-amino-N-butyl-N-gamma-sulfobutylaniline; 4-amino-3-methyl-N-ethyl-N-β-sulfoethylaniline; 4-amino-3-β-(methanesulfonamido)ethyl-N,N-diethylaniline; 4-amino-3-methyl-N-ethyl-N-β-(methanesulfonamido)ethylaniline; 4-amino-3-methyl-N-ethyl-Nβ-methoxyethylaniline and the like.

The term "reducing agent", as used herein, is intended to include compounds which are reducing agent precursors in the described recording layer. That is, those compounds are intended to be included which are not reducing agents in the recording layer until a condition occurs, such as heating of the recording layer.

An especially useful reducing agent is one that consists essentially of a paraphenylenediamine silver halide developing agent that exhibits an E ½ value in aqueous solution at pH 10 within the range of −25 to +175 millivolts versus SCE. The term "E ½ value" herein means half wave potential. The term "SCE" herein means saturated calomel electrode. These values are determined by analytical procedures known in the photographic art and described in, for example, the text "The Theory of the Photographic Process", fourth edition, Mees and James, 1977, pages 318 and 319.

The described reducing agent is useful in a range of concentrations in the described element according to the invention. Selection of an optimum concentration of reducing agent or combination of reducing agents will depend upon the described factors including the desired image, the particular silver salt oxidizing agent, the particular dye-forming coupler, processing conditions and the like. A useful concentration of reducing agent or combination of reducing agents is within the range of about 0.1 to about 5.0 moles of reducing agent per mole of organic silver salt in the recording layer as described. An especially useful concentration of reducing agent is within the range of about 0.2 to about 2 moles of reducing agent per mole of organic silver salt in the recording layer.

The tone of the combined silver image and dye image produced according to the invention varies, depending upon such factors as the silver morphology of the developed silver image, the covering power of the silver materials, the particular dye-forming coupler, the particular developing agent, processing conditions and the like. In recording layers that produce a brown silver image, the hue of the dye image produced is preferably complementary to the hue of the silver image. An image hue of the combined dye image and silver image is preferably "neutral".

The term "neutral", as employed herein, includes hues which occasionally are described in the photographic art as blue-black, gray, purple-black, black and the like. Whether or not a given image is "neutral" is readily determined by visual inspection with the unaided eye.

Procedures for determining whether or not an image is "neutral" are known in the photographic art, such as described in *Research Disclosure*, September 1978, Item No. 17326.

Silica is generally useful in an image recording layer of a recording element according to the invention. Silica in the recording layer helps produce increased density in a developed image upon imagewise exposure and heating the recording layer. Many forms of silica are useful. However, colloidal silica is especially useful because it has a large surface area. The optimum concentration of silica in the recording layer depends upon such factors as the desired image, other components in the recording layer, processing conditions, layer thickness and the like. The concentrations of silica generally is within the range of about 1 to about 1,000 milligrams per 500 square centimeters of support. The silica is a disadvantage in some cases, such as in preparation of a high resolution transparency, because the silica reduces resolution of the developed image and causes undesired light scattering.

The average particle size and particle size range of silica in the recording layer varies. The optimum average particle size and particle size range of silica depends upon the described factors regarding silica concentration. The average particle size and particle size range of colloidal silica generally are most useful. Colloidal silica that is useful includes some commercially available colloidal silica products as "Cab-O-Sil", a trademark of and available from the Cabot Corporation, U.S.A., and "Aerosil", a trademark of and available from DEGUSSA, West Germany. It is important that the average particle size and particle size range of the silica or any other equivalent particles not adversely affect the desired properties of the electrically activated recording element of the invention or the desired image produced upon imagewise exposure and heating of the recording layer. For instance, the silica selected should not decrease sensitivity of the recording layer or produce undesired fogging of the developed image.

The mechanism and properties which cause colloidal silica to produce increased density in a recording layer according to the invention is not fully understood. It is believed that the large surface area of colloidal silica contributes to the desired results. An especially useful embodiment of the invention, as described, is one containing colloidal silica in the recording layer of a charge-sensitive recording paper according to the invention.

The described element according to the invention comprises no separate binder or comprises a variety of colloids and polymers alone or in combination as vehicles and binding agents. These vehicles and binding agents are in various layers of the element, especially in the recording layer. Suitable materials are hydrophobic or hydrophilic. It is necessary, however, that the vehicle or binder in the element not adversely affect the charge sensitivity or ohmic resistivity of the element of the invention. Accordingly, the selection of an optimum colloid or polymer, or combination of colloids or polymers, depends upon such factors as the desired charge sensitivity, desired ohmic resistivity, particular polymer, particular components in the layer, desired image and particular processing conditions. Useful colloids and polymers are transparent or translucent and include both naturally occurring substances, such as proteins, for example, gelatin, gelatin derivatives, cellulose derivatives, polysaccharides, such as dextran, gum arabic and the like. Synthetic polymers, however, are preferred, due to their desired charge sensitivity properties and ohmic resistivity properties. Useful polymeric materials for this purpose include polyvinyl compounds, such as poly(vinyl pyrrolidone), acrylamide polymers and dispersed vinyl compounds, such as in latex form. Effective polymers include water insoluble polymers of alkylacrylates and methacrylates, acrylic acid, sulfoalkylacrylates, methacrylates and those which have cross-linking sites which facilitate hardening or curing. Especially useful polymers are high molecular weight materials and resins which are compatible with the described components of the element according to the invention. These include, for example, poly(vinyl butyral), cellulose acetate butyrate, poly(methyl methacrylate), poly(vinyl pyrrolidone), ethyl cellulose, polystyrene, poly(vinyl chloride), poly(isobutylene), butadiene-styrene copolymers, vinyl chloride-vinyl acetate copolymers, copolymers of vinyl acetate, vinyl chloride and maleic acid and poly(vinyl alcohol). Combinations of colloids and polymers are also useful, depending upon the described factors. Highly preferred binders include polyacrylamide, as well as copolymers of acrylamide and other vinyl addition monomers, such as copolymers of acrylamide and vinyl imidazole or copolymers of acrylamide and N-methyl acrylamide.

An overcoat layer is useful on the recording layer according to the invention. It is important that the overcoat layer not adversely affect the desired charge sensitivity and ohmic resistivity properties of the element according to the invention. Such an overcoat layer reduces fingerprinting and abrasion marks before and after exposure and processing. The overcoat layer is one or more of the described polymers which are useful as binders. These materials must be compatible with other components of the described element according to the invention and must be able to tolerate the processing temperatures which are useful for developing the described images.

In most cases, a photosensitive component is unnecessary and undesirable in the electrically activated recording layer, as described. The photosensitive component is any photosensitive metal salt or complex which produces developable nuclei upon charge exposure according to the invention. If a photosensitive element is present in the recording layer, an especially useful photosensitive metal salt is photosensitive silver halide, due to its desired properties in forming developable nuclei upon charge exposure. A concentration of photosensitive metal salt is within the range of about 0.0001 to about 10.0 moles of photosensitive metal salt per mole of organic silver salt in the described element according to the invention. For example, a useful concentration range of photosensitive silver halide is within the range of about 0.001 to about 2.0 moles of silver halide per mole of organic silver salt in the recording element. A preferred photosensitive silver halide is silver chloride, silver bromide, silver bromoiodide or mixtures thereof. For purposes of the invention, silver iodide is also considered to be a photosensitive silver halide. Very fine grain photographic silver halide is useful, although a range of grain size from fine grain to coarse grain photographic silver halide is included in the recording layer, if desired. The photographic silver halide is prepared by any of the procedures known in the photographic art. Such procedures and forms of photographic silver halide are described in, for example, the *Product Licensing Index*, December 1971, Publication No. 9232, and *Research Disclosure*, December 1978, Item No. 17643. The photographic silver halide, if desired, is washed or unwashed, is chemically sensitized by means of chemical sensitization procedures known in the art, is protected against the production of fog and stabilized against loss of sensitivity during keeping, as described in the above *Product Licensing Index* and *Research Disclosure* publications.

If a photosensitive component is present in the described electrically activated recording layer, the described image-forming combination enables the concentration of the photosensitive component to be lower than normally would be expected in a photosensitive element. This lower concentration is enabled by the amplification effect of the image-forming combination, as described, as well as the formation of developable nuclei according to the invention, in addition to the dye enhancement of the silver image formed. In some instances, the concentration of photosensitive metal salt is sufficiently low that, after imagewise exposure and development of the photosensitive metal salt alone, in the absence of other of the described imaging components, the developed image is not visible to the unaided eye.

The elements according to the invention, if desired, contain addenda which aid in producing a desired image. These addenda include, for example, development modifiers that function as speed-increasing compounds, hardeners, plasticizers and lubricants, coating aids, brighteners, spectral sensitizing dyes, absorbing and filter dyes. These addenda are described in, for example, the *Product Licensing Index*, December 1971, Publication No. 9232, and *Research Disclosure*, December 1978, Item No. 17643.

While it is in most cases unnecessary and undesirable, a post-processing stabilizer or stabilizer precursor to increase post-processing stability of the developed image is included in the described recording layer, if desired. In many cases, the recording layer following processing is sufficiently stable to avoid the need for incorporation of a stabilizer or stabilizer precursor in the recording layer. However, in the case of recording materials which contain photosensitive silver halide, it is generally desirable to include such a stabilizer or post-processing stabilizer precursor to provide increased post-processing stability. Many stabilizer or stabilizer precursors are useful in the elements according to the invention. These stabilizers or stabilizer precursors are useful alone or in combination, if desired. Useful stabilizers or stabilizer precursors include, for instance, photolytically active polybrominated organic compounds. Thioethers or blocked azolinethione stabilizer precursors or other organic thione stabilizer precursors known to be useful in photothermographic materials are useful, if desired.

When a stabilizer or stabilizer precursor is present in the recording layer of an element according to the invention, a range of concentrations of stabilizer or stabilizer precursor is useful. The optimum concentration of stabilizer or stabilizer precursor will depend upon such factors as the particular element, processing conditions, particular stabilizer or stabilizer precursor, desired stability of the developed image and the like. A useful concentration of stabilizer or stabilizer precursor is within the range of about 1 to about 10 moles of stabilizer or stabilizer precursor per mole of photosensitive component in the element according to the invention.

It is often advantageous to include a neat sensitive base release agent or base precursor in the recording element according to the invention to produce improved and more effective image development. A base release agent or base precursor herein includes compounds which, upon heating in the recording layer, produce a more effective reaction between the described components of the image-forming combination and, in addition, produce improved reaction between the oxidized form of the described reducing agent and the dye-forming coupler. Examples of useful heat sensitive base release agents or base precursors are aminimide base release agents, such as described in *Research Disclosure*, May 1977, Item Nos. 15733, 15732, 15776 and 15734; guanidinium compounds, such as guanidinium trichloroacetate; and other compounds which are known to the photothermographic art to release a base moiety upon heating, but do not adversely affect the desired properties of the recording element. Combinations of heat sensitive base release agents are useful, if desired.

A heat sensitive base release agent or base precursor and combinations of such compounds are useful in a range of concentrations in the described elements according to the invention. The optimum concentration of heat sensitive base release agent or base precursor will depend upon such factors as the desired image, particular dye-forming coupler, particular reducing agent, other components of the imaging element, processing conditions and the like. A useful concentration of described base release agent is within the range of about 0.25 to 2.5 moles of base release agent or base precursor per mole of reducing agent in the recording layer according to the invention.

The charge-sensitive element according to the invention comprises an electrically conductive support. The term "electrically conductive support" herein includes (a) supports that are electrically conductive without the need for separate addenda in the support or on the support to produce the desired degree of electrical conductivity, and (b) supports that comprise addenda or separate electrically conductive layers that enable the desired degree of electrical conductivity. Useful supports include electrically conductive cellulose ester, poly(vinyl acetal), poly(ethylene terephthalate), polycarbonate and polyester film supports and related films and resinous materials. Other supports are useful, such as glass, paper, metal and the like which can withstand the processing temperatures described and do not adversely affect the charge-sensitive properties and ohmic resistivity which is desired. A flexible support is most useful. It is necessary that the various layers according to the invention adhere to the support. A subbing layer to aide adhesion is preferred on the support. Such a subbing layer is, for example, a poly(methyl-acrylate-co-vinylidene chloride-co-itaconic acid) subbing layer. This subbing layer is illustrated by subbing layer 53 in FIG. 5.

The recording element, in one embodiment of the invention, includes an electrically conductive layer positioned between the subbed support and the described electrically active conductive (EAC) layer. The electrically conductive layers, as described, such as layers 62 and 55 in FIG. 5, comprise electrically conducting compounds which do not adversely affect the charge sensitivity and ohmic resistivity properties of an element according to the invention. Examples of useful electrically conductive layers include layers comprising an electrically conductive nickel or a chromium composition, such as cermet.

An especially useful embodiment of the invention is an electrically activated recording element, as described, which has an electrically active conductive layer (EAC layer) between the electrically conductive support and the electrically activated recording layer. This is illustrated by EAC layer 56 in FIG. 5. The EAC layer can comprise a suitable electrically conductive polymer. An example of a suitable polymer for this purpose includes poly(alkyl acrylate-co-vinylidene chloride-co-itaconic acid). Suitable polymers for the subbing layer are described in, for example, U.S. Pat. No. 3,271,345, the disclosure of which is incorporated herein by reference.

Figure 5:
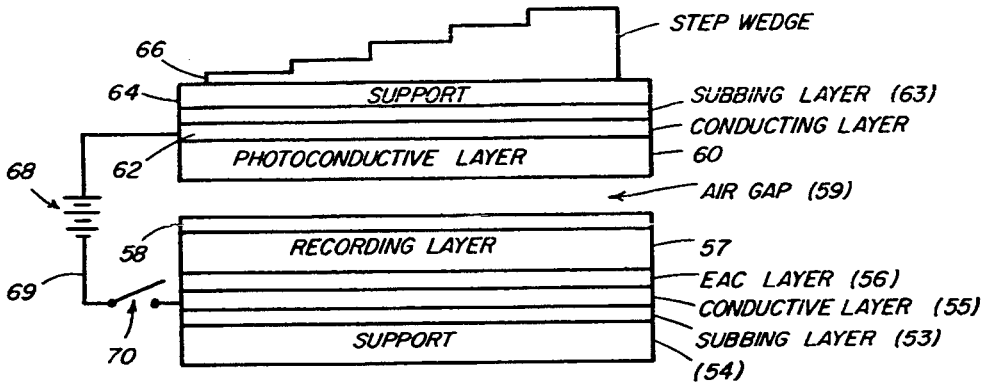
FIG. 5 illustrates schematically an image recording material that is especially useful according to the invention.

In some embodiments, the photoconductive layer is a self-supporting layer, such as a photoconductor in a suitable binder. In such embodiments, an electrically conductive layer, such as an electrically conductive nickel or chromium composition layer, is coated on the photoconductive layer. This is illustrated in, for instance, FIG. 3 in the drawings in which electrically conductive layer 28 is on photoconductive layer 30 which is self supporting. Alternatively, the photoconductive layer is coated on an electrically conductive support, such as illustrated in FIG. 5 of the drawings. Subbing layer 63, such as poly(alkyl acrylate-co-vinylidene chloride-co-itaconic acid) subbing layer, aides the photoconductive layer 60 in FIG. 5 in adhering to support 64.

The described layers according to the invention are coated by coating procedures known in the photographic art, including dip coating, airknife coating, curtain coating or extrusion coating, using hoppers known in the photographic art. If desired, two or more layers are coated simultaneously.

The various components of the charge-sensitive materials according to the invention are prepared for coating by mixing the components with suitable solutions or mixtures, including suitable organic solvents, depending upon the particular charge-sensitive material and the components. The components are added by means of procedures known in the photographic art.

Useful charge-sensitive elements according to the invention comprise an electrically conductive support having thereon an electrically activatable recording layer which has a thickness within the range of about 1 to about 30 microns, typically within the range of about 2 to about 15 microns. The optimum layer thickness of each of the layers of an element according to the invention depends upon such factors as the particular ohmic resistivity desired, charge sensitivity, particular components of the layers and the desired image.

A "melt-forming compound" is useful in the recording layer according to the invention to produce an improved developed image. A "melt-forming compound" is especially useful with recording materials containing silver salts of nitrogen acids. The term "melt-forming compound" herein is intended to mean a compound which, upon heating to the described processing temperature, produces an improved reaction medium, typically a molten medium, wherein the described image-forming combination can produce a desired image upon development. The exact nature of the reaction medium at the processing temperature described is not fully understood. It is believed that at the reaction temperature, as described, a melt occurs which permits the reaction components to better interact. If desired, a melt-forming compound is included with other components of the recording layer prior to coating on the described support. Examples of useful melt-forming compounds include succinimide, dimethyl urea, sulfamide and acetamide.

The optimum concentration of the described components of the element according to the invention depends upon a variety of factors, as described. An especially useful recording element according to the invention comprises about 1 to about 5 moles of the described dye-forming coupler for each 1 to 5 moles of the described reducing agent and about 3 to about 20 moles of the described organic silver salt oxidizing agent.

The described organic silver salt oxidizing agent contains a range of ratios of the organic moiety to the silver ion. The optimum ratio of the organic moiety to silver ion in the organic silver salt oxidizing agent depends upon such factors as the particular organic moiety, the particular concentration of silver ion desired, processing conditions and the particular dye-forming coupler. The molar ratio of organic moiety to silver as silver ion in the salt generally is within the range of about 0.5:1 to about 3:1.

The image recording layer of the invention has a range of pAg. The pAg is measured using conventional calomel and silver-silver chloride electrodes, connected to a commercial digital pH meter. Typically, the pAg in a dispersion containing the described components for the recording layer is within the range of about 2.5 to about 7.5. The optimum pAg depends upon the described factors, such as the desired image and processing conditions.

A recording material containing the described organic silver salt oxidizing agent typically has a pH within the range of about 1.5 to about 7.0. An especially useful pH for the described recording layer is within the range of about 2.0 to about 6.0.

The desired resistivity characteristics of a recording material according to the invention is obtained by separately measuring the current-voltage characteristic of each sample coating at room temperature by means of a mercury contact sample holder to make a mercury contact to the surface of the coating. To eliminate the possibility that a micro thickness surface air gap might affect the measured resistivity, exposures are made with an evaporated metal (typically, gold or aluminum) electrode on the surface of a charge sensitive and photoconductor coating to be tested. The resistivity is measured at various ambient temperatures. The data is measured at a voltage of, for example, 20 volts or $4\times10^4$ volts per centimeter, which is within the ohmic response range of the layer to be tested. It is expected that the resistivity of the charge-sensitive layer will vary widely with temperature. It is also expected that the dielectric strength of the layer will vary with temperature. The selection of an optimum temperature for exposure is determined based on the dielectric strength of the layer.

An especially useful embodiment of the invention having the desired characteristics comprises a charge-sensitive recording element, preferably having an ohmic resistivity of at least about $10^4$ ohm-cm comprising, in sequence: (a) a first electrical conducting layer, (b) a photoconductive layer, (c) an electrically activated recording layer separated from (b) by an air gap of up to about 20 microns and comprising, in reactive association: (A) a dye-forming coupler consisting essentially of 2',6'-dihydroxytrifluoroacetanilide, (B) an image-forming combination consisting essentially of (i) an organic silver salt oxidizing agent consisting essentially of a silver salt of 3-amino-5-benzylthio-1,2,4-triazole, with (ii) a reducing agent consisting essentially of 4-amino-2-methoxy-N,N,5-trimethylaniline sulfate, and (C) a polyacrylamide binder, (d) an EAC layer comprising a poly(alkyl acrylate-co-vinylidene chloride-co-itaconic acid) on (e) a second electrical conducting layer, on (f) a support.

Many energy sources are useful for imagewise exposure of a recording element according to the invention. Selection of an optimum energy source for imagewise exposure will depend upon the described factors, such as the sensitivity of the photoconductive layer, the particular image recording combination in the electrically activated recording layer and desired image. Useful energy sources for imagewise exposure include, for example, visible light, X-rays, lasers, electron beams, ultraviolet radiation, infrared radiation and gamma rays.

A variety of processing steps and means are useful for producing a dye image and silver image in the described recording layer after imagewise exposure. In one embodiment of the invention, a dry electrically activated recording process for producing a dye image and silver image, preferably a dye enhanced silver image, in a charge-sensitive recording element, preferably having an ohmic resistivity of at least about $10^4$ ohm-cm, containing at least one electrically activated recording image-forming combination consisting essentially of (A) a dye-forming coupler, and (B) an image-forming combination as described, comprises the steps: (I) applying an electric potential imagewise to the recording element of a magnitude and for a sufficient time to produce in the image areas a charge density within the range of about $10^{-3}$ coulomb/cm$^2$ to about $10^{-9}$ coulomb/cm$^2$, the charge density forming a developable latent image in the image-forming combination; and then (II) heating the recording element substantially uniformly at a temperature and for a time sufficient to produce a dye image and silver image, preferably a dye enhanced silver image.

An especially useful process embodiment of the invention is a dry electrically activated recording process for producing a dye enhanced silver image in a charge-sensitive recording element, preferably having an ohmic resistivity of at least about $10^4$ ohm-cm comprising, in sequence, a support having thereon (a) a first electrically conductive layer, (b) an organic photoconductive layer, (c) an electrically activated recording layer separated from (b) by an air gap of up to 20 microns, and comprising (A) a dye-forming coupler consisting essentially of a compound selected from the group consisting of 2,6-dihydroxyacetanilide and 2',6'-dihydroxytrifluoroacetanilide and combinations thereof, (B) an image-forming combination comprising (i) an organic silver salt oxidizing agent consisting essentially of a silver salt of 3-amino-5-benzylthio-1,2,4-triazole, with (ii) a reducing agent consisting essentially of 4-amino-2-methoxy-N,N,5-trimethylanilinesulfate, and (iii) a polyacrylamide binder, (d) an EAC layer, and (e) a second electrically conductive layer; said process comprising the steps: (I) imagewise altering the conductivity of the photoconductive layer in accord with an image (X') to be recorded while simultaneously (II) applying across the photoconductive layer and recording layer an electrical potential of a magnitude and for a sufficient time to produce a developable latent image in the recording layer corresponding to the image (X'); and then (III) heating the recording layer substantially uniformly at a temperature and for a time sufficient to produce a dye enhanced silver image corresponding to image (X') in the recording layer.

An imagewise current flow is produced through the described electrically activated recording layer. Although a particular technique to produce an imagewise current flow has been described for use in a variety of recording apparatus, the especially useful techniques are those which include use of a photoconductive layer as an image to current converter. Alternatively, imagewise current flow is provided, however, by contacting the recording element with a suitable electrostatically charged means, such as an electrostatically charged stencil or scanning the recording element with a beam of electrons.

Heating the recording element after latent image formation is carried out by techniques and means known in the photothermographic art. For example, the heating is carried out by passing the imagewise exposed recording element over a heated platen or through heated rolls, by heating the element by means of microwaves, by means of dielectric heating or by means of heated air. A visible image is produced in the described exposed material within a short time, that is, within about 1 to about 90 seconds, by the described uniform heating step. An image having a maximum transmission density of at least 1.8 and typically at least 2.2 is produced according to the invention. For example, the recording element is uniformly heated to a temperature within the range of about 100° C. to about 200° C. until a desired image is developed, typically within about 1 to about 90 seconds. The imagewise exposed material according to the invention is preferably heated to a temperature within the range of about 120° C. to about 180° C. The optimum temperature and time for processing depends upon such factors as the desired image, the particular recording element and heating means.

The described electrically activated recording process is useful for producing multiple copies. According to this embodiment of the invention, multiple copies are prepared by a dry, electrically activated recording process for producing a dye image and silver image, preferably a dye enhanced silver image, in an electrically activated recording element comprising the steps: (I) imagewise altering the conductivity of a photoconductive layer (Z) in accord with an image that is to be recorded; (II) positioning the imagewise altered photoconductive layer (Z) from (I) adjacent an electrically activated recording layer of the recording element comprising (A) a dye-forming coupler, and (B) an image-forming combination comprising (i) an organic silver salt oxidizing agent, with (ii) a reducing agent which, in its oxidized form, forms a dye with the dye-forming coupler, wherein the photoconductive layer is separated from the recording layer by an air gap of up to 20 microns, (III) applying an electrical potential across the photoconductor layer and recording layer of a magnitude and for a sufficient time to produce in the areas of the recording layer corresponding to the imagewise altered portions of the photoconductor layer a charge density within the range of about $10^{-3}$ coulomb/cm$^2$ to about $10^{-9}$ coulomb/cm$^2$, the charge density forming in the areas a developable latent image; then (IV) uniformly heating the recording element at a temperature and for a time sufficient to produce a dye image and silver image, preferably a dye enhanced silver image, in the recording element; followed by (V) positioning the imagewise altered photoconductor layer adjacent a second electrically activated recording layer, preferably having an ohmic resistivity of at least about $10^4$ ohm-cm, wherein said photoconductor layer is separated from said second recording layer by an air gap of up to 20 microns; (VI) applying an electrical potential across the photoconductor layer and the second recording layer of a magnitude and for a time sufficient to produce in the areas of the image of said photoconductive layer a charge density within the range of about $10^{-3}$ coulomb/cm$^2$ to about $10^{-9}$ coulomb/cm$^2$, the charge density forming a developable latent image; and then (VII) uniformly heating the second recording layer at a temperature and for a time sufficient to produce a developed image in the second recording layer.

While the exact mechanism of image formation upon heating is not fully understood, it is believed that the imagewise exposure to charge provides nuclei in the image areas. It is believed that the nuclei formed in the image areas increase the reaction rate and act as catalysts for the reaction between the organic silver salt oxidizing agent and the reducing agent. It is believed that the nuclei enable a form of amplification which would not otherwise be possible. The described organic silver salt oxidizing agent and reducing agent must be in a location with respect to each other which enables the nuclei formed to provide the desired catalytic effect. The described organic silver salt oxidizing agent and reducing agent, as well as the dye-forming coupler, are in reactive association in the electrically activated recording layer. The term "in reactive association" is intended to mean that the nuclei resulting from the imagewise exposure are in a location with respect to the described components which enables desired catalytic activity, desired processing temperature and capability for a more useful dye image and silver image.

Figure 2:
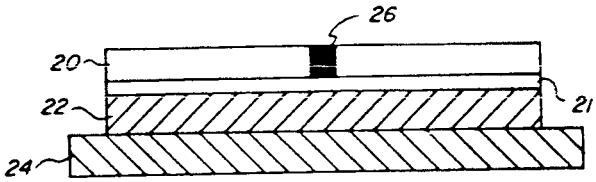

Referring to the drawings, embodiments of the invention are depicted schematically in FIGS. 1 and 2. According to the embodiment illustrated in FIGS. 1 and 2, a charge-sensitive recording layer 10 is placed upon a grounded electrically conductive backing or support 12. A current is selectively applied to the recording layer 10 by the point of a metal stylus 14 which is raised to a sufficiently high voltage relative to the support 12 by a voltage source 16, and brought into moving contact with the exposed surface of the recording layer 10 containing the described image-forming combination and dye-forming coupler. Upon contacting the recording layer 10 with the stylus 14, a current flow is produced in the areas of the recording layer contacted by the stylus and a developable latent image forms, i.e., a pattern of nuclei sites, in the pattern desired. The charge density produced by the stylus in the contacted areas of the recording layer need not be sufficient to produce a visible image in the recording layer 10; however, the charge density must be sufficient to produce a latent image in the recording layer in those areas contacted by the stylus. Although a particular technique to produce an imagewise current flow through the recording layer 10 has been described, techniques for producing imagewise current flow generally known in the art of recording are useful and are intended to be encompassed by the description. The area of the recording layer 10 designated as 18 is intended to be illustrative of an area of nuclei sites formed upon contact of the stylus 14 with the recording layer 10. Other techniques for producing a nuclei pattern include, for example, contacting the recording layer 10 with an electrostatically charged stencil or scanning the layer 10 with a beam of electrons in an image pattern.

FIG. 2 illustrates development of the latent image formed in the recording element in FIG. 1 by, for example, moving the element from FIG. 1 into contact with a heated metal platen 24. The heat from platen 24 passes through the support 22 to the layer 20 containing the latent image to cause the desired reaction in the latent image area. The reaction in the latent image area causes development to produce a visible image 26 consisting essentially of a dye image and silver image, preferably a dye enhanced silver image, in the recording layer 20. Upon development, the recording element is removed from the platen 24. No processing solutions or baths are required in this heat development step.

Figure 3:
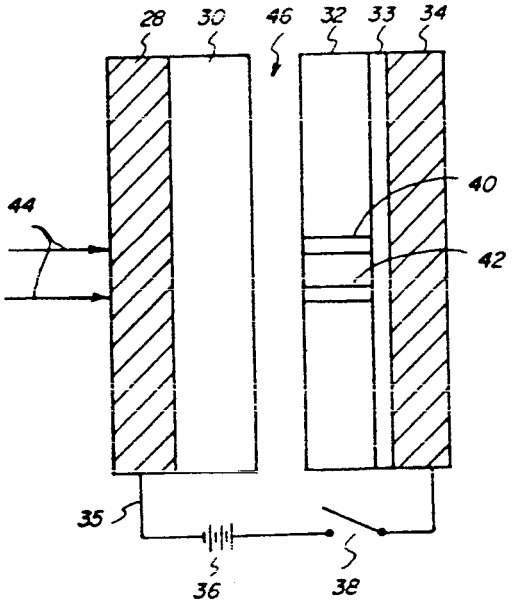
FIGS. 3 and 4 illustrate schematically an electrically activated recording process embodying the described invention.
Figure 4:
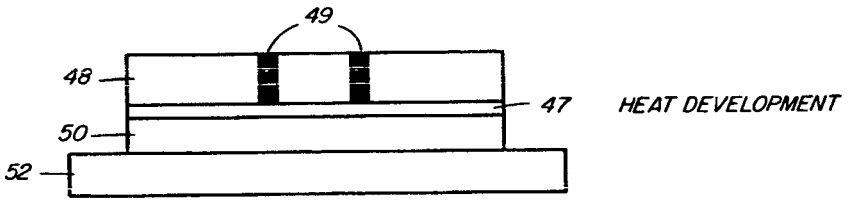

Another illustrative embodiment of the invention is schematically shown in FIGS. 3 and 4. In this embodiment, in FIG. 3, the developable sites 40 and 42, that is the latent image sites, are formed by sandwiching a charge-sensitive recording layer 32 and an image-to-current converted layer 30, preferably a photoconductive layer, between a pair of electrically conductive layers 28 and 34. Layers 28 and 34 can comprise suitable supports for layers 30 and 32, or layers 28 and 34 can be on separate suitable supports, not shown, such as film supports. A high potential electric field is established across the photoconductive layer 30 and recording layer 32 by connecting the conductive layers 28 and 34 by connecting means 35 containing power source 36. The electric field across the layers is controlled by switch 38. The latent image formation at latent image sites 40 and 42 is caused by imagewise exposing the photoconductive layer 30 through the conductor 28 to exposure means 44, typically actinic radiation, preferably X-ray. The layer 28 and any support for layer 28 must be sufficiently transparent to the energy 44 to enable the energy to pass to a desired degree to photoconductive layer 30. The exposure selectively increases the conductivity of the conductive layer in those regions exposed to actinic radiation. When switch 38 is closed, thereby establishing an electric field across the layers, an imagewise current flow is produced through the recording layer 32. The current flow occurs in those regions of the recording layer 32 only in position with the exposed portions of the photoconductive layer 30. An air gap 46 of up to 20 microns is provided between layers 30 and 32. The air gap 46 is, for example, 1 to 10 microns. After a sufficient charge density, typically less than 1 millicoulomb/cm$^2$, preferably about 1.0 microcoulomb/cm$^2$, has been produced in the current exposed portions of the recording layer 32, switch 38 is opened, thereby disrupting the current flow.

The described technique for application of voltage across the photoconductive and recording layers is illustrative. A variety of techniques known in the recording art are useful and are intended to be included in this description. For example, a grid control corona discharge means, not shown, is substituted, if desired, for the voltage source and conducting layer 28.

To develop the dye image and silver image in latent image sites 40 and 42, the recording element containing layers 32 and 34 is moved away from the photoconductive layer. Connecting means 35 is also disconnected. The recording element illustrated in FIG. 4 is then contacted with a heated platen 52 illustrated in FIG. 4. The heat from the platen 52 passes through the support 50 to the layer 48 containing a latent image to produce a visible dye image and silver image 54. The heating is preferably carried out substantially uniformly by merely positioning the recording element in heat transfer relationship with the heated platen 52. After the development of the silver image and the dye image, the recording element is removed from the platen.

An especially useful embodiment of the invention is illustrated in FIG. 5 in the drawings. In FIG. 5, the charge-sensitive recording arrangement consists of a support 54 having thereon a subbing layer 53 and an electrically conductive layer 55, typically consisting of cermet having thereon an EAC layer 56, such as an alkyl acrylate polymer layer. On the EAC layer 56 is coated a recording layer 57 containing the image-forming combination and dye-forming coupler. An air gap 59, typically about 1 micron thick, is present between overcoat layer 58 on recording layer 57 and a lead monoxide photoconductive layer 60. The layer 60 has a nickel electrically conductive layer 62 which is on a subbing layer 63 on a transparent film support 64. Developable nuclei are formed in recording layer 57 by imagewise exposure with a suitable radiation source, such as a tungsten light source or X-ray source, not shown, through step tablet 66. At the time of imagewise exposure with the energy source, a high potential electric field is established across the photoconductive and image-recording layers by connecting the conductive layer 62 and the electrically conductive layer 55 by connecting means 69 through a power source 68. The electric field across the layers is controlled by switch 70. After the necessary charge density is established, switch 70 is opened, thereby disrupting the current flow. Imagewise exposure for about 1 second at about 50 footcandles produces a developable image in recording layer 57. A 0.3 density step wedge 66 is used for imagewise exposure purposes, if desired. To develop the resulting latent image, layer 55 is disconnected from connecting means 69 and power source 68 and moved away from the photoconductive layer 60. The recording layer 57 is then heated uniformly by contacting it with a heated metal platen, not shown, until the desired dye image and silver image are produced.

Interlayers are useful in certain instances in the charge-sensitive recording element as desired, to help avoid undesired transfer of components of the described layers. Useful interlayers are described in, for example, U.S. Pat. No. 3,978,335 of Gibbons.

The photoconductive layer, such as the layer 60 in FIG. 5, includes a variety of binders and/or sensitizers known in the electrophotographic art. Useful binders are described in, for example, U.S. Pat. No. 2,361,019 of Gerhart and U.S. Pat. No. 2,258,423 of Rust. Sensitizing compounds useful in the photoconductive layer are described in, for example, U.S. Pat. No. 3,978,335 of Gibbons.

In the embodiments illustrated which have an air gap between the photoconductor and image recording layers, the air gap distances are controlled by methods known in the art, such as by the roughness of the surface of the photoconductor layer, as well as the roughness of the surface of the image recording layer. The air gap need not be uniform. However, best results are often observed with a uniform air gap. The air gap is, for example, up to about 20 microns thick, preferably within the range of about 1 to about 10 microns thick. For example, the distances shown in FIG. 3 between photoconductor layers 30 and 32 are up to 20 microns, such as within the range of about 1 to about 10 microns, as illustrated by air gap 46.

The resistivity of a useful recording layer according to the invention is effected by such factors as exposure history, the direction of the applied field and, when sandwiched with a photoconductor, by air gap effects and photoconductor effects. The number of variables affecting the resistance of the recording layer coupled with non-ohmic behavior of the layer at higher applied fields can affect the choice of an optimum recording material and imaging means. The resistivity values as described herein for particular recording materials are therefore values measured under temperature and voltage conditions which produce desired ohmic behavior.

If desired, the recording element and imaging means according to the invention are readily modified to provide a continuous image recording operation. This is carried out by means of desired control circuitry and continuous transport apparatus, not shown.

The following examples are included for a further understanding of the invention.

EXAMPLE 1

This illustrates a negative-working electrically activatable recording element and process according to the invention for producing a dye image and silver image.

The element and layers for this example are similar to those described in FIG. 5.

The following composition was coated on a poly(ethylene terephthalate) film support 54 containing a poly(methyl acrylate-co-vinylidene chloride-co-itaconic acid) layer 53 and a cermet conducting layer 55 with an EAC layer 56 consisting of poly(methyl acrylate-co-vinylidene chloride-co-itaconic acid):

| | | |
|---|---|---|
| silver 3-amino-5-benzylthio-1,2,4-triazole (1.5:1 ligand to silver ion ratio) (dispersed in 1% gelatin) | 8.0 ml | |
| methyl mercaptotriazole (1% solution in ethanol) (antifoggant) | 0.3 ml | |
| 4-phenyl-3-imino-5-thiourazole (1% solution in ethanol) (development accelerator) | 0.3 ml | |
| surfactant (Surfactant 10G, which is a polyglycidolether available from the Olin Corporation, U.S.A.) (10% solution in water) | 0.2 ml | |
| 4-amino-methoxy-N,N,5-trimethyl-aniline sulfate (reducing agent) | 75 mg | (dissolved in 1 ml of water) |
| 2',6'-dihydroxytrifluoroacet-anilide (dye-forming coupler) | 180 mg | (dissolved in 1 ml of water) |

The composition after mixing was coated at a 5 mil wet coating thickness to produce a recording layer (57 in FIG. 5) containing 90 to 100 milligrams of silver per 929 $cm^2$ of support.

The layer 60 consisted of a 17 micron thick coating of a composite type organic photoconductor consisting essentially of an aggregate organic photoconductor as described in U.S. Pat. No. 3,615,414 as the photoconductive compound. The photoconductor was coated on conducting layer 62 consisting of copper iodide on a subbed poly(ethylene terephthalate) film support 64 shown in FIG. 5. An air gap of up to 20 microns separated the photoconductor layer 60 from recording layer 57. Visible light exposure imagewise was made with simultaneous application of a voltage of positive 4,000 volts to the resulting sandwich shown in FIG. 5. The intensity and duration of light exposure were sufficient to produce a developable latent image in the recording layer 57. A charge exposure of 100 microcoulombs/cm$^2$ was used for forming a latent image in the recording layer 57.

The photoconductive layer and the recording layer were separated after imagewise exposure and the recording layer was uniformly heated for 10 seconds at 160° C. This produced a silver image and dye image in the exposed areas of the recording layer. A 1.0 transmission density image was observed in the area exposed to charge.

EXAMPLE 2

A recording element as described in Example 1 was prepared, with the exception that the described accelerator was not included in the recording layer. Visible light exposure imagewise was made with several silver film test objects by means of the photoconductor described in Example 1 with simultaneous application of 1,800 volts to the described so-called sandwich. A positive polarity was applied to the photoconductor. The 15 seconds' exposure to visible light was made by means of a 55-footcandle yellow fluorescent illumination source (about 500 to 700 nanometers).

The resulting exposed recording layer was separated from the photoconductive layer. The recording layer was then uniformly heated for 20 seconds at 180° C. This produced a developed silver image and dye image in the exposed areas. The resulting negative image had a maximum transmission density of about 1.0 and a minimum transmission density of about 0.20.

EXAMPLE 3

A charge recording element was prepared as described in Example 1.

X-ray exposures were made imagewise of several metallic test objects by means of a 90 micron thick coating of a photoconductor containing tetragonal lead oxide photoconductor and photoconductive layer 60, as shown in FIG. 5. The photoconductive layer was coated on a conducting layer consisting essentially of nickel which was coated on a poly(ethylene terephthalate) film support. The photoconductive layer served as a current transducer for the X-ray imaging. Exposures were made for 20 seconds using 110 kVp X-rays from a commercially available X-ray energy source. A voltage of 3,200 volts was applied to the so-called sandwich during the imagewise exposure with X-rays. A positive polarity was applied to the photoconductor.

After imagewise exposure, the recording layer was separated from the photoconductive layer. The exposed recording layer was then heated for 10 seconds uniformly at 180° C. A developed silver image and dye image were produced in the recording layer.

The resulting developed negative image had a maximum transmission density of about 1.2 to 1.1, and a minimum transmission density of 0.20. The tone of the developed image was neutral (black).

EXAMPLE 4

A charge recording element was prepared as described in Example 1, with the exception that the silver salt oxidizing agent contained no gelatin binder. The silver salt oxidizing agent consisted of a binderless 1.5:1 ligand to silver ion dispersion of a silver salt of 3-amino-5-benzylthio-1,2,4-triazole. Charge exposures were made by means of a grid controlled corona exposure device, not shown in the drawings, applying a positive 1,000 volt grid potential. The exposure device is described in, for example, U.S. Pat. No. 3,370,212.

The exposed recording layer was subsequentially processed by uniformly heating for 12 seconds at 160° C. A developed dye enhanced silver image was produced. The developed image had a maximum transmission density of 1.9. It was found that such an image could be produced with a charge of about 100 microcoulombs/cm$^2$.

The procedure was repeated, with the exception that the charge exposure was 4 microcoulombs/cm$^2$. This produced a developed image having a maximum transmission density of 1.0, and a minimum transmission density of 0.20.

EXAMPLE 5

A charge recording element was prepared as described in Example 1, with the exception that the silver salt oxidizing agent composition contained a binder consisting of poly(acrylamide-1-vinylimidazole) (90:10). The silver salt oxidizing agent contained 1.5:1 ligand to silver ion. Charge exposures were made by means of a grid controlled corona exposure device, not shown in the drawings, as in Example 4. The exposed recording layer was processed as described in Example 4 to produce a developed dye enhanced silver image.

The invention has been described in detail with particular reference to preferred embodiments thereof, but it will be understood that variations and modifications can be effected within the spirit and scope of the invention.

What is claimed is:

1. In an electrically activatable recording element comprising an electrically conductive support having thereon, in sequence:

(a) an electrically activatable recording layer comprising an organic silver salt and a reducing agent, (b) a photoconductive layer separated from (a) by an air gap of up to 20 microns, and (c) and electrically conductive layer on (b), the improvements comprising, as said recording layer, the following, in reactive association:

(I) (A) a dye-forming coupler, and (B) an oxidation-reduction combination comprising (i) an organic silver salt oxidizing agent, with (ii) a reducing agent which, in its oxidized form, forms a dye with said dye-forming coupler; and (II) an electrically active conductive layer on said electrically conductive support.

2. An electrically activatable recording element as in claim 1 wherein said dye-forming coupler is a resorcinol, dye-forming coupler.

3. An electrically activatable recording element as in claim 1 wherein said dye-forming coupler is a resorcinol, dye-forming coupler represented by the formula:

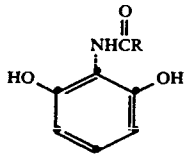

wherein R is hydroxy, phenyl, alkyl containing 1 to 20 carbon atoms, or haloalkyl.

4. An electrically activatable recording element as in claim 1 wherein said dye-forming coupler is a compound selected from the group consisting of 2',6'-dihydroxyacetanilide and 2',6'-dihydroxytrifluoroacetanilide and combinations thereof.

5. An electrically activatable recording element as in claim 1 wherein said organic silver salt oxidizing agent is a silver salt of a 1,2,4-mercaptotriazole derivative represented by the formula:

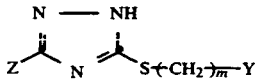

wherein

Y is aryl containing 6 to 12 carbon atoms;

m is 0 to 2; and

Z is hydrogen, hydroxyl or amine.

6. An electrically activatable recording element as in claim 1 wherein said organic silver salt oxidizing agent consists essentially of a silver salt of 3-amino-5-benzylthio-1,2,4-triazole.

7. An electrically activatable recording element as in claim 1 also comprising an electrically conductive binder in said electrically activated recording layer.

8. An electrically activatable recording element as in claim 1 also comprising an electrically conductive binder consisting essentially of a copolymer of acrylamide and vinyl imidazole.

9. An electrically activatable recording element comprising, in sequence:

(a) a first support having thereon (b) a first electrical conducting layer, and (c) a photoconductive layer, having thereover (d) an electrically activatable recording layer separated from (c) by an air gap of up to 20 microns, and comprising, in an electrically conductive polyacrylamide binder, in reactive association:

(A) a dye-forming coupler consisting essentially of 2',6'-dihydroxytrifluoroacetaniilide, (B) an oxidation-reduction combination consisting essentially of (i) an organic silver salt oxidizing agent consisting essentially of a silver salt of 3-amino-5-benzylthio-1,2,4-triazole, with (ii) a reducing agent consisting essentially of 4-amino-2-methoxy-N,N,5-trimethylaniline sulfate, (e) an electrically active conductive layer, and (f) a second electrically conductive layer, on (g) a second support.

10. A dry, electrically activated recording process for producing a dye enhanced silver image in an electrically activatable recording element comprising an electrically conductive support having thereon, in sequence, an electrically active conductive layer and an electrically activatable recording layer comprising at least one electrically activatable recording, image-forming combination comprising, in an electrically conductive binder, in reactive association:

(A) a dye-forming coupler, and (B) an oxidation-reduction combination comprising (i) an organic silver salt oxidizing agent, with (ii) a reducing agent which, in its oxidized form, forms a dye with said dye-forming coupler, said process comprising the steps:

(I) applying an electric potential imagewise to said recording element of a magnitude and for a sufficient time to produce in the image areas a charge density within the range of about $10^{-3}$ coulomb/cm$^2$ to about $10^{-9}$ coulomb/cm$^2$, said charge density forming a developable latent image in the image-forming combination; and, (II) heating said recording element substantially uniformly at a temperature within the range of 80° to 200° C. and for a time sufficient to develop a dye enhanced silver image.

11. A dry, electrically activated recording process for producing a dye enhanced silver image in an electrically activatable recording element comprising, in sequence:

(a) a first electrically conductive layer, (b) a photoconductive layer, (c) an electrically activated recording layer separated from (b) by an air gap of up to 20 microns and comprising, in an electrically conductive binder, in reactive association:

(A) a dye-forming coupler, and (B) an oxidation-reduction combination comprising (i) an organic silver salt oxidizing agent, with (ii) a reducing agent which, in its oxidized form, forms a dye with said dye-forming coupler, and (d) an electrically active conductive layer on (e) an electrically conductive support;

said process comprising (I) imagewise altering the conductivity of said photoconductive layer in accord with an image to be recorded, while simultaneously (II) applying an electrical potential across said photoconductive layer and said recording layer of a magnitude and for a time sufficient to produce a developable latent image in said recording layer corresponding to the image to be recorded; and, (III) heating said recording layer substantially uniformly at a temperature within the range of 80° to 200° C. and for a time sufficient to produce a dye enhanced silver image in said recording layer.

12. A process as in claim 11 wherein said recording layer is heated in (III) to a temperature within the range of about 100° C. to about 180° C. until a dye enhanced silver image is produced in said recording layer.

13. A dry, electrically activated recording process for producing a dye enhanced silver image in an electrically activatable recording element comprising, in sequence:

(a) a first support having thereon (b) a first electrically conductive layer, and (c) a photoconductive layer, having thereover (d) an electrically activatable recording layer separated from (c) by an air gap of about up to 20 microns, and comprising, in an electrically conductive polyacrylamide binder, (A) a dye-forming coupler consisting essentially of a compound selected from the group consisting of 2',6'-dihydroxyacetanilide and 2',6'-dihydroxytrifluoroacetanilide and combinations thereof, (B) an oxidation-reduction combination comprising (i) an organic silver salt oxidizing agent consisting essentially of a silver salt of 3-amino-5-benzythio-1,2,4-triazole, with (ii) a reducing agent consisting essentially of 4-amino-2-methoxy-N,N,5-trimethylaniline sulfate, (e) an electrically active conductive layer, and (f) a second electrically conductive layer on (g) a second support, said process comprising (I) imagewise altering the conductivity of said photoconductive layer in accord with an image to be recorded, while simultaneously (II) applying an electrical potential across said photoconductor layer and recording layer of a magnitude and for a sufficient time to produce a developable latent image in said recording layer corresponding to said image to be recorded; and, (III) heating said recording layer substantially uniformly at a temperature within the range of 80° to 200° C. and for a time sufficient to produce a dye enhanced silver image in said recording layer.

14. A process as in claim 13 wherein said recording layer is heated in (III) to a temperature within the range of about 100° C. to about 180° C. until a dye enhanced silver image is produced in said recording layer.

15. A dry, electrically activated recording process for producing a dye enhanced silver image in an electrically activatable recording element comprising an electrically conductive support having thereon, in sequence, an electrically active conductive layer, and, contiguous to said electrically active conductive layer, an electrically activatable recording layer; said process comprising the steps:

(I) imagewise altering the conductivity of a photoconductive layer (Z) in accord with an image that is to be recorded.

(II) positioning the imagewise altered photoconductive layer (Z) from (I) within 20 microns adjacent an electrically activated recording layer of said recording element comprising, in an electrically conductive binder, in reactive association:

(A) a dye-forming coupler, and (B) an oxidation-reduction combination comprising (i) an organic silver salt oxidizing agent, with (ii) a reducing agent which, in its oxidized form, forms a dye with said dye-forming coupler;

(III) applying an electrical potential across said photoconductive layer and recording layer of a magnitude and for a sufficient time to produce in the areas of said recording layer corresponding to the imagewise altered portions of said photoconductive layer a charge density within the range of about $10^{-3}$ coulomb/cm$^2$ to about $10^{-9}$ coulomb/cm$^2$, said charge density forming in said areas a developable latent image; and, (IV) uniformly heating the recording element at a temperature within the range of 80° to 200° C. and for a time sufficient to produce a dye enhanced silver image in said recording element.

16. A dry, electrically activated recording process as in claim 15 also comprising the steps:

(V) positioning said imagewise altered photoconductive layer within 20 microns adjacent a second electrically activated recording layer;

(VI) applying an electrical potential across said photoconductive layer and said second recording layer of a magnitude and for a sufficient time to produce in the areas of said image of said photoconductive layer a charge density within the range of about $10^{-3}$ coulomb/cm$^2$ to about $10^{-9}$ coulomb/cm$^2$, said charge density forming a developable latent image; and, (VII) uniformly heating said second recording layer at a temperature within the range of 80° to 200° C. and for a time sufficient to produce a developed image in said second recording layer.

17. A dry, electrically activated recording process for producing a dye enhanced silver image in an electrically activatable recording element comprising an electrically conductive support having thereon, in sequence, an electrically active conductive layer, and, contiguous to said electrically active conductive layer an electrically activatable recording layer comprising, in an electrically conductive binder, in reactive association:

(A) a dye-forming coupler, and (B) an oxidation-reduction combination comprising (i) an organic silver salt oxidizing agent, with (ii) a reducing agent, which in its oxidized form, forms a dye with said dye-forming coupler, said process comprising the steps:

(I) positioning said recording element in face-to-face relationship with a photoconductive element wherein said recording element is separated from said photoconductive element by an air gap of up to 20 microns;

(II) exposing said photoconductive element to an imagewise pattern of actinic radiation while simultaneously applying an electrical potential having a field strength of at least about $1\times10^4$ volts/cm across said photoconductive element and said recording element for a time sufficient to provide a developable latent image in the areas of said recording element corresponding to the exposed areas of said photoconductive element; and (III) substantially uniformly heating the recording element at a temperature within the range of 80° to 200° C. and for a time sufficient to produce a dye enhanced silver image in said recording element.

18. A process as in claim 17 wherein the impedance of said recording element differs from the impedance of said photoconductive element by no more than about $10^5$ ohm-cm when said electrical potential is applied across said photoconductive element and said recording element.

19. A process as in claim 17 wherein said electrical potential produces a charge flow within the range of about $10^{-3}$ coulomb/cm$^2$ to about $10^{-9}$ coulomb/cm$^2$ in the areas of said recording element corresponding to the exposed areas of said photoconductive element.

20. A process as in claim 17 wherein said recording element in (III) is substantially uniformly heated to a temperature within the range of about 100° C. to about 180° C. until a dye enhanced silver image is produced.

21. A process as in claim 17 wherein said photoconductive element is X-ray sensitive and the conductivity of said element is imagewise altered by exposing said photoconductive element to X-ray radiation in accord with an image to be recorded.

22. A process as in claim 17 wherein said dye-forming coupler is a compound selected from the group consisting of 2',6'-dihydroxyacetanilide and 2',6'-dihydroxytrifluoroacetanilide and combinations thereof; said organic silver salt oxidizing agent consists essentially of a silver salt of 3-amino-5-benzylthio-1,2,4-triazole; and said reducing agent consists essentially of 4-amino-2-methoxy-N,N,5-trimethylaniline sulfate.

23. A dry, electrically activated recording process for producing a dye enhanced silver image in an electrically activatable recording element comprising an electrically active conductive layer, and, contiguous to said electrically active conductive layer, an electrically activatable recording layer comprising, in an electrically conductive binder, in reactive association:

(A) a dye-forming coupler, and (B) an oxidation-reduction combination comprising (i) an organic silver salt oxidizing agent, with (ii) a reducing agent which, in its oxidized form, forms a dye with said dye-forming coupler;

said process comprising the steps:

(I) positioning said recording element on an electrically conductive backing member;

(II) modulating a corona ion current flow to the recording element by an electrostatic field established imagewise between an image grid comprising an electroconductive core sequentially connectable to sources of different potential relative to said backing member and covered with a coating of a photoconductive insulating material and a control grid that is electrically conductive and sequentially connectable to sources of different potential relative to said backing member, said current flow being of a magnitude sufficient to produce a charge density within the range of about $10^{-3}$ to about $10^{-9}$ coulomb/cm$^2$ imagewise in said recording element, which charge density forms a developable latent image in said electrically activated recording material; and (III) substantially uniformly heating said recording element at a temperature within the range of 80° to 200° C. and for a time sufficient to produce a dye enhanced silver image in said recording element.

* * * * *